US006364106B1

(12) United States Patent
Fagg et al.

(10) Patent No.: US 6,364,106 B1
(45) Date of Patent: Apr. 2, 2002

(54) PACKAGE WITH EMBOSSED PRODUCT SYMBOL AND A METHOD OF ASSOCIATING A SYMBOL WITH A PRODUCT

(75) Inventors: Barry Smith Fagg, Winston-Salem; Aurelius Madison Waggoner, III, Walkertown, both of NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 0 days.

(21) Appl. No.: 09/595,657

(22) Filed: Jun. 16, 2000

(51) Int. Cl.[7] ..... B65D 85/10; B65D 43/16

(52) U.S. Cl. ..... 206/268; 40/312; 206/273; 206/459.5; 229/160.1

(58) Field of Search ..... 206/26 A–268, 206/271–276, 459.5; 40/312, 313; 229/160.1

(56) References Cited

U.S. PATENT DOCUMENTS

| | | | | | |
|---|---|---|---|---|---|
| 283,741 | A | * | 8/1883 | Appleberg | 40/312 |
| 476,765 | A | * | 6/1892 | Knapp | 40/312 |
| 1,128,052 | A | * | 2/1915 | Roy | 40/313 |
| 1,142,020 | A | * | 6/1915 | Carver | 206/459.5 |
| 1,186,194 | A | * | 6/1916 | Hohfelt | 206/459.5 |
| 2,803,394 | A | | 8/1957 | Ringler | |
| 2,824,684 | A | | 2/1958 | Ahlers | |
| 2,886,234 | A | | 5/1959 | Toensmeier | |
| 2,922,564 | A | | 1/1960 | Van Rosen | |
| 2,950,043 | A | | 8/1960 | Ringler | |
| 4,251,022 | A | | 2/1981 | Focke | |
| 4,392,338 | A | | 7/1983 | Fox | |
| 5,066,270 | A | | 11/1991 | Tomanovits | |
| 5,137,148 | A | | 8/1992 | Evers | |
| 5,236,084 | A | | 8/1993 | Evers | |
| 5,261,209 | A | | 11/1993 | Focke et al. | |
| 5,341,925 | A | | 8/1994 | Fleenor et al. | |
| 5,363,955 | A | | 11/1994 | Fleenor | |
| 5,738,207 | A | | 4/1998 | Trimani | |
| 5,788,065 | A | * | 8/1998 | Focke | 206/268 |
| 5,806,671 | A | | 9/1998 | Focke et al. | |
| 5,823,331 | A | * | 10/1998 | Manservigi et al. | 206/268 |
| 5,965,227 | A | * | 10/1999 | Focke | 206/273 |

* cited by examiner

*Primary Examiner*—Bryon P. Gehman

(57) ABSTRACT

A logo-reinforcing package contains a bundle of products, such as cigarettes. The package has a hinged lid which uncovers the ends of the cigarettes, and an innerframe with a cutout which exposes portions of the cigarettes when the package is opened. To teach the consumer to associate the product logo and the product, the logo is imprinted or embossed in the innerframe adjacent the exposed portion of the product. The consumer views the product and the logo simultaneously each time the lid is opened to extract a cigarette, and therefore is taught to associate the logo and the product.

19 Claims, 1 Drawing Sheet

PACKAGE WITH EMBOSSED PRODUCT SYMBOL AND A METHOD OF ASSOCIATING A SYMBOL WITH A PRODUCT

BACKGROUND OF THE INVENTION

1. Field of the Invention

The present invention relates to a package for a product and a method of reinforcing a consumer's awareness of a product symbol, such as a logo, and its association with the product. The invention also relates to subliminal teaching of an association between a product and a logo or symbol associated with it. More particularly, the invention relates to providing an embossed product logo or symbol on a type of package known as a hinged lid box that is especially suited for the packaging of cigarettes.

2. Description of the Prior Art

Animals, especially large animals, are of great interest to humans. In addition, they are highly symbolic. Animals represent human qualities, such as wisdom (owl) or bravery (lion), and are commonly chosen to represent a group, such as a sports team, or a nation, for example, a bald eagle for America. A symbolic animal image is referred to herein as a "totem." Totems are often used as product symbols, logos or trademarks. The tiger, for example, is used as a logo or trademark for well known brands of gasoline and cereal. A large predator like a tiger is very effective at capturing a consumer's attention and imagination, and thus is an effective logo.

One goal of advertising is to make consumers aware of a brand and to help them remember it. To accomplish this goal, a logo must become firmly associated with the product in the mind of the consumer. This means that the consumer must learn to associate the logo with the product.

Learning requires attention and repetition. To forge an association between a product and a logo, the consumer should perceive both together, and repeatedly. Because animals attract attention, totem logos offer more opportunities to reinforce brand awareness than other types of logos. However, the attention attracted by a totem, or any other logo, will not increase brand awareness and sales unless the consumer learns to associate the totem with the product. Building brand awareness is a teaching process for the manufacturer and a learning process for the consumer.

In the prior art, logos have been placed on products and/or their packaging, thus bringing the product and logo into close juxtaposition. But the association learning process has not always been optimized because, in general, the consumer has not always been presented with the logo and the product simultaneously or juxtaposed as closely as possible.

Cigarettes are often imprinted with a logo on the paper wrapper or filter paper. However, this logo is typically concealed by the packaging until the cigarette is removed. therefrom. Moreover, the consumer is likely not to even notice the logo while in the process of lighting the cigarette or during smoking. Logos are also typically placed on all sides of most cigarette packages. Despite the many logos, trademarks and designs used to create product recognition, they may not be noticed by the consumer simultaneously with seeing the cigarette product per se, because the consumer's attention is focused at the open end of the pack, where the cigarettes are located. When extracting a cigarette, a consumer may not look directly at the package and the consumer's hand may partly cover the outside of the package, obscuring any logo located there.

It is advantageous that the consumer's attention not be distracted when the package is opened and the product is seen for the first time; this should be a moment in which the product is fully appreciated. To best forge an association between a logo and the product, the logo should be seen when the consumer first looks at the product itself, that is, when the package is first opened. The opening of the pack is a time of high product awareness, but in the case of prior art logo placement, it is a time when the association between the logo and the product is quite low. Because brand logo association is a learning process, it would be desirable to place the logo so as to bring it in the field of view of the consumer each time the package is opened for extraction of a product.

The prior art does not provide these advantages. For example, U.S. Pat. No. 5,137,148 issued to Evers discloses a hinged lid cigarette box in which the innerframe has an extension which protrudes upwardly to partially cover the cigarettes and may include printing, embossing and/or debossing. This extension is removable by tearing along a perforation, and is intended to be used as a coupon. Evers does not disclose any logo on the coupon. If the coupon were to be imprinted with a logo, it would not repetitively teach the consumer to associate the product and logo because the coupon covers the cigarettes, preventing the logo and product from being seen together, and furthermore, is intended to be torn away from the package. It also distracts the consumer since it places an impediment in the way of extracting the product from the package.

SUMMARY OF THE INVENTION

The present invention overcomes the drawbacks of the prior art by printing or embossing a totem or other product symbol non-removably onto a package in such a position that the consumer will see the symbol and the product simultaneously, at the moment of opening the package to extract one of the products, and each time the package is opened and closed.

An object of the present invention is to increase sales of a product, particularly cigarettes, by repeatedly reinforcing the mental association between a product and a totem, emblem, brand name, letter or letters, word or words, 'symbol, logo, or trademark of the product.

Preferably, the logo or totem is of a size sufficient to be readily recognized by the consumer as a product symbol and is represented in plural, for example, as a repeating pattern. In this way, according to a method aspect of the invention, the consumer is taught repeatedly to associate the product symbol with the product, not only by reason of the repeating pattern, but also by association each time the package is opened. Thus, learning is easier and the association is strengthened.

According to the present invention, the logo or totem is disposed on the package immediately adjacent a portion of the product which is most identifiable with the product as a whole. In the case of hinged lid cigarette packages, the logo or totem is preferably placed on a non-removable portion of the package closely adjacent the cigarette product so as to be visible continuously and simultaneously with the product when the hinged lid is opened.

The foregoing objects of the invention are achieved in a preferred embodiment of a hinged lid cigarette box by placing one or a plurality of the totems, logos, or symbols immediately adjacent the cutout portion of a conventional "innerframe" or "collar" of the hinged lid cigarette box. The cutout exposes the cigarette filter and its connection to the paper-wrapped cigarette rod when the package is opened. In this way, the logo or logos appear immediately next to that portion of the cigarettes which is most identifiable as a cigarette.

The hinged lid cigarette package is preferably a semi-rigid paperboard or "crush-proof" type of box. This type of hinged lid box typically is constructed with a paperboard insert known as an innerframe or collar, which includes a generally U-shaped cutout through which lateral side portions of at least some of the cigarettes in the package are visible. Preferably, the logo or logos are disposed in a repeating pattern along the edge or edges of the innerframe cutout. Most preferably, the logo or logos are embossed into a non-removable portion of the material of the innerframe. Embossment advantageously provides tactile as well as visual stimulation, adds visual impact, and increases the consumer's attention, as well as the rapidity at which the consumer learns to associate the product with the logos, totems or symbols. As used herein, the term "non-removable" portion means a portion of the package or innerframe that is not designed, constructed or intended to be removable as distinguished from a portion of the package that is intended to be removable, such as the coupon disclosed in U.S. Pat. No. 5,137,148.

In a conventional hinged lid cigarette package, a relatively small vertical portion of the innerframe is exposed between the upper edge of the front panel of the box and the edge of the cutout in the innerframe. Accordingly, the logo should have a relatively short vertical height. One sort of symbol which might be printed or embossed on the innerframe is the brand name of the product, e.g., CAMEL. To be most closely associated with the product, this brand name is preferably restricted in width to correspond to the width of the innerframe cutout, that is, where the cigarettes are exposed when the lid is opened. However, in a preferred embodiment, several logos or totems, each of approximately the same area or size as the cross-sectional area or diameter of a cigarette, are placed in a row along the front panel of the innerframe. In this way, the association of the cigarette with the logo or totem is most easily taught to the consumer and each cigarette appears to be "labeled" by its own totem.

Another advantageous feature of the invention relates to enhancing the consumer's perception of quality of the product as well as the product symbol or logo even during closing of the hinged lid of the cigarette box. According to this aspect of the invention, the rear corners of the innerframe are radiused or rounded so as to minimize the possibility that when the lid is closed, it will hang up on the innerframe corners and either irritate the consumer or distract the consumer from viewing the product logo or symbol.

DETAILED DESCRIPTION OF THE INVENTION

Figure 1:
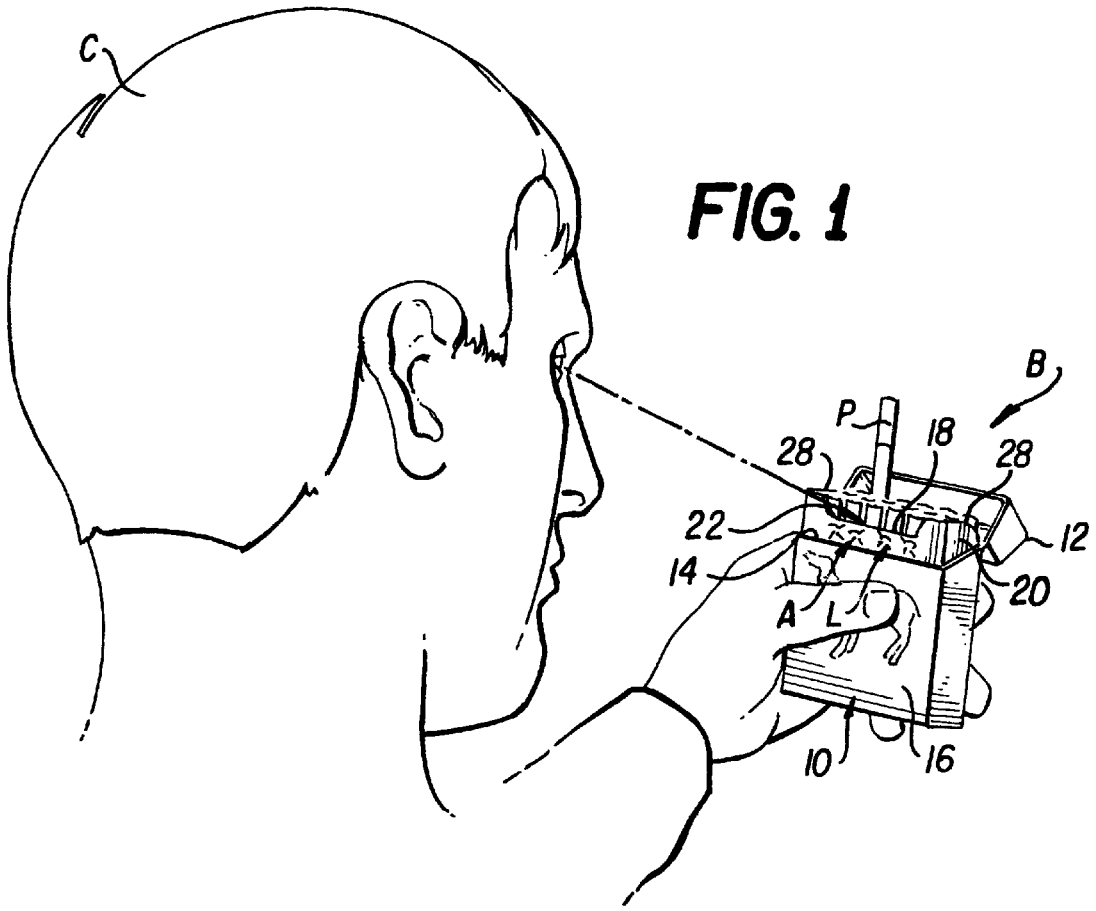
FIG. 1 is a perspective view of a consumer opening a box of cigarettes embossed on the innerframe with totems or logos.

FIG. 1 shows a preferred embodiment of the invention in the form of a "crush-proof" cigarette box B with a body 10 and a hinged lid 12 of conventional semi-rigid paperboard construction. Inside the box B is the product P, a plurality of cigarettes, typically twenty cigarettes. A consumer C is shown holding the box B and looking at the cigarette products P and logos L, explained in more detail below.

Attached to the body 10, for example, with glue, is a paperboard innerframe or collar 20 which surrounds the cigarettes P on the sides of the box B and partially in front. As is conventional, the innerframe of the present invention includes a generally U-shaped cutout 22. The cutout typically exposes the filter-end portions of several cigarettes in the front row of cigarettes that would otherwise be concealed from view but for the existence of the cutout 22.

The upper edge 14 of the front panel 16 of box body 10 and the lowermost edge 18 of the cutout 22 are substantially parallel to one another, and define between them an area A of the innerframe which heretofore has not been used for advertising purposes. According to the present invention, one or more logos L are located on the innerframe in the area A so as to associate the logos L with the product P in the mind of the consumer C.

In the preferred embodiment depicted in FIG. 1, the logos L comprise totems (camels) which are associated with a particular product, in this case, a brand of cigarettes; however, any logo or product symbol can be used in the area A within the scope of the present invention. Preferably, several logos L are provided, arrayed in a row between the edge 18 of the cutout 22 and the top edge 14 of the front panel 16 of the box, and are sufficiently small to fit into the area A. The logos L are also comparable in size with the cigarette product P, i.e., the logos have a cross-sectional area approximately equal to the cross-sectional area of an individual cigarette, or, the transverse dimension of the logo is about the same as the diameter of a cigarette.

Immediately upon opening the lid 12 and removing any foil covering (not shown) from the cigarettes, the attention of the consumer C is drawn to the exposed portions of the cigarette products P and the logos L juxtaposed closely adjacent to one another, and desirably remains drawn to them as he or she reaches for a cigarette. Because of the size similarity between the cigarettes P and the logos L, each cigarette appears to be "labeled" with its own logo L and an association between the logo and the cigarette is made that may be subliminal. It is the combination of simultaneous viewing, and close juxtaposition, of the cigarette portions exposed in the cutout 22 and the logos L which best reinforces the desired mental association between the product P and logo L. The closer they are in time and space, the greater the reinforcement.

Figure 2:
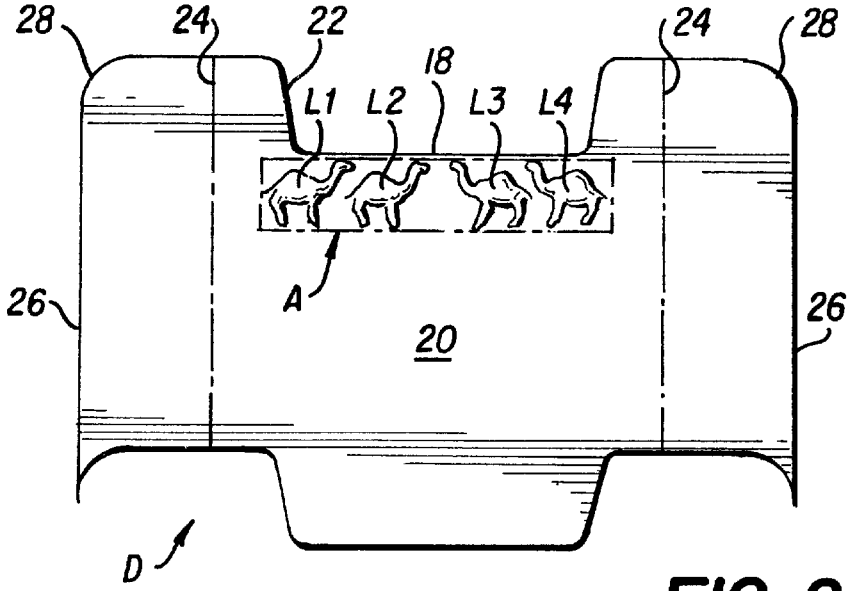
FIG. 2 is a plan view of an innerframe blank embossed with totem logos.

FIG. 2 shows a blank D of paperboard or other suitable material from which the innerframe 20 is made. As is conventional, the innerframe blank D includes two symmetrical wings or side panels 26, each of which is foldable along a respective fold line 24 for insertion and fastening into the box body 10 in a conventional manner. According to the preferred embodiment of the invention, a plurality of logos L1, L2, L3, L4 are embossed into a non-removable portion of the material of the blank D by conventional embossing means so that the logos appear in relief, i.e., high-relief, half-relief, bas-relief, or hollow-relief. The logos L1–L4 may also be printed in bold and/or contrasting colors, be iridescent, or otherwise configured to attract attention. Preferably, the logos L1–L4 are located in area A just beneath the cutout 22, although it is within the scope of the invention to locate the logos adjacent the sides of the cutout 22, e.g., between the fold lines 24 and the cutout 22.

An advantage of embossing the logos in bas-relief in area A is that the embossments will function to retain the hinged lid in the closed position after the lid is pushed closed by the consumer after a cigarette has been extracted. In the preferred embodiment, as best seen in FIG. 2, the logos L1–L4 are two pair of totem camels with the camels of at least one pair facing one another. This arrangement adds interest and attracts attention because the animals appear to be interacting.

A further feature of the innerframe blank D of the invention is that it includes rounded corners 28 which, in the assembled box B, are adjacent the hinged lid as best seen in FIG. 1. Rounded corners 28 prevent the lid 12 from "hanging up" on the innerframe 20 during closing of the lid and thus prevent any irritation of the consumer C with the product and any distraction from the consumer's association of the logo with the product.

The present invention also contemplates that one or more logos may be printed or embossed on a strip of paperboard from which innerframe blanks are then cut out in alignment with the logos or cut out from the strip and fastened, e.g., by adhesive, to a previously cut out innerframe blank. It is also contemplated within the scope of the invention to place logos along an edge of a container adjacent the products which are exposed either when the container is opened or when the products are extracted from the container.

Although certain presently preferred embodiments of the present invention have been specifically described herein, it will be apparent to those skilled in the art to which the invention pertains that variations and modifications of the various embodiments shown and described herein maybe made without departing from the spirit and scope of the invention. Accordingly, it is intended that the invention be limited only to the extent required by the appended claims and the applicable rules of law.

What is claimed is:

1. A package adapted to contain a product comprising a box body and a lid hinged to the box body, said lid having a closed position and an open position in which the product may be extracted from the box body, an innerframe attached to the box body so as to be exposed when the lid is in the open position, a product symbol disposed on a non-removable portion of said innerframe, said non-removable portion being non-removable when the lid is in the open position, said non-removable portion having said product symbol being positioned on said innerframe so as to be concealed when the lid is closed and exposed each time the lid is opened.

2. The package of claim 1, wherein said product symbol is embossed in said innerframe.

3. The package of claim 2, wherein the product symbol is an embossed animal logo.

4. The package of claim 1, including a plurality of product symbols embossed in said innerframe.

5. The package of claim 1, wherein said innerframe includes a cutout portion having an edge, said box body having a front panel with an upper edge, the edge of said cutout and the upper edge of said front panel defining an innerframe area therebetween, a plurality of product symbols being embossed in said innerframe area.

6. The package of claim 1, wherein said innerframe includes a cutout portion having an edge, said box body having a front panel with an upper edge, the edge of said cutout and the upper edge of said front panel defining an innerframe area therebetween, a plurality of product symbols being printed in said innerframe area.

7. The package of claim 1, wherein the package is a hinged lid cigarette box and the product is cigarettes.

8. The package of claim 1, wherein the product symbol is one of a logo, a brand name, a letter or letters, and a word or words.

9. The package of claim 1, the portion of the innerframe comprises a strip adhesively fastened to the innerframe.

10. The package of claim 1, wherein the package is a hinged lid cigarette box and the product is cigarettes, each cigarette having a cross-sectional area, the product symbol comprising a plurality of logos each having an area substantially corresponding to the cross-sectional area of a cigarette.

11. The package of claim 1, wherein the package is a hinged lid cigarette box and the product is cigarettes, each cigarette having a diameter, the product symbol comprising a plurality of logos each having dimensions substantially corresponding to the diameter of a cigarette.

12. The package of claim 1, wherein the innerframe comprises a pair of side panels with rounded corners adjacent the hinged lid.

13. In a package containing a plurality of consumer products, the package including an innerframe with a cutout and a hinged lid which is openable to expose through the cutout a portion of at least some of the products, and a product symbol on the package for teaching the consumer to associate the product symbol with the product, the improvement comprising the product symbol being applied to a non-removable portion of the innerframe adjacent the cutout, the non-removable portion being non-removable when the lid is in the open position, whereby the product and the product symbol on the non-removable portion are simultaneously and repeatedly associated when the lid is opened.

14. The package of claim 13, wherein the product is cigarettes and the package comprises a hinged lid paperboard cigarette box.

15. A method of teaching a consumer to associate a product and a product symbol, the method comprising the steps of providing a package including a box body, an innerframe with a cutout and a hinged lid which is openable to extract a product from the box body, the cutout exposing a portion of the product, and embossing a product symbol in a non-removable portion of the innerframe, the non-removable portion being non-removable when the lid is in the open position, whereby the product and the product symbol on the non-removable portion are simultaneously and repeatedly associated by the consumer upon each opening of the hinged lid.

16. A package adapted to contain a product comprising a box body having a front panel with an upper edge and a lid hinged to the box body, said lid having a closed position and an open position in which the product may be extracted from the box body, an innerframe attached to the box body so as to be exposed when the lid is in the open position, said innerframe having a generally U-shaped cutout with a lowermost edge, the upper edge of the front panel and the lowermost edge of the cutout defining an innerframe area therebetween, a product symbol disposed on said innerframe area, said product symbol being exposed when the lid is in the open position.

17. A package adapted to contain a product comprising a box body having a front panel with an upper edge and a lid hinged to the box body, said lid having a closed position and an open position in which the product may be extracted from the box body, an innerframe attached to the box body so as to be exposed when the lid is in the open position, said innerframe having an upwardly open, generally U-shaped cutout defined by two side edges and a lowermost edge, the upper edge of the front panel and the lowermost edge of the cutout being substantially parallel and defining an innerframe area located below the cutout, a product symbol disposed on said innerframe area, said innerframe area being non-removable and exposed when the lid is in the open position.

18. A package adapted to contain a product comprising a box body having a lid hinged to the box body, said lid having a closed position and an open position in which the product may be extracted from the box body, an innerframe having a cutout and being attached to the box body so as to be exposed when the lid is in the open position, said innerframe having no removable portions, a product symbol disposed on said innerframe, said product symbol being exposed when the lid is in the open position.

19. A package adapted to contain a product comprising a box and a lid hinged to the box body, said lid having a closed position and an open position in which the product may be extracted from the box body, an innerframe attached to the box body so as to be exposed when the lid is in the open position, a product symbol disposed on a portion of said innerframe that is non-removable and exposed when the lid is in the open position.

* * * * *